US008439098B1

(12) United States Patent
Jones et al.

(10) Patent No.: US 8,439,098 B1
(45) Date of Patent: May 14, 2013

(54) CLOSING-BIASED RETRACTABLE SCREEN DOOR SYSTEM

(76) Inventors: Brian E. Jones, Hoschton, GA (US); Brian G. Hughes, Indian Lakes Estates, FL (US)

( * ) Notice: Subject to any disclaimer, the term of this patent is extended or adjusted under 35 U.S.C. 154(b) by 0 days.

(21) Appl. No.: 13/199,786

(22) Filed: Sep. 9, 2011

(51) Int. Cl.
*E06B 3/48* (2006.01)

(52) U.S. Cl.
USPC ..... 160/116; 160/23.1; 160/267.1; 160/271; 160/180

(58) Field of Classification Search ..... 160/116, 160/180, 23.1, 267.1, 271, 265
See application file for complete search history.

(56) References Cited

U.S. PATENT DOCUMENTS

| | | | | | |
|---|---|---|---|---|---|
| 1,025,721 | A * | 5/1912 | Eanet | 160/40 |
| 1,413,895 | A * | 4/1922 | Claveria | 160/116 |
| 1,549,714 | A * | 8/1925 | Claveria | 160/23.1 |
| 3,522,834 | A * | 8/1970 | Corcoran | 160/23.1 |
| 3,938,577 | A * | 2/1976 | Richards | 160/90 |
| 4,003,102 | A * | 1/1977 | Hawks et al. | 16/72 |
| 4,301,623 | A * | 11/1981 | Demukai | 49/404 |
| 4,874,026 | A * | 10/1989 | Worrall | 160/23.1 |
| 4,891,911 | A * | 1/1990 | Yung | 49/404 |
| 5,285,596 | A * | 2/1994 | Kinsey | 49/404 |
| 5,579,607 | A * | 12/1996 | Braid | 49/404 |
| 5,579,820 | A * | 12/1996 | LePage et al. | 160/268.1 |
| 5,850,672 | A * | 12/1998 | Dalton | 16/81 |
| 6,006,814 | A * | 12/1999 | Dalpe | 160/116 |
| 6,079,472 | A * | 6/2000 | Schanz | 160/265 |
| 6,186,212 | B1 * | 2/2001 | Tsuchida | 160/84.06 |
| 6,318,438 | B1 * | 11/2001 | Uno et al. | 160/31 |
| 6,679,000 | B2 * | 1/2004 | Uken et al. | 49/181 |
| 6,820,368 | B2 * | 11/2004 | Uken et al. | 49/181 |
| 6,915,988 | B2 * | 7/2005 | Sanz et al. | 244/129.3 |
| 6,978,820 | B2 * | 12/2005 | Aoki | 160/84.06 |
| 7,025,106 | B2 * | 4/2006 | Donnelly | 160/90 |
| 7,730,929 | B2 * | 6/2010 | Perron | 160/202 |
| 7,921,898 | B2 * | 4/2011 | Brioschi | 160/311 |
| 8,002,341 | B2 * | 8/2011 | Hotta et al. | 296/214 |
| 8,151,858 | B2 * | 4/2012 | Hughes et al. | 160/113 |
| 2001/0054260 | A1 * | 12/2001 | Plum et al. | 49/447 |
| 2003/0041522 | A1 * | 3/2003 | Cauchon | 49/404 |
| 2008/0115416 | A1 * | 5/2008 | Clark | 49/142 |
| 2008/0163988 | A1 * | 7/2008 | Hicks et al. | 160/267.1 |
| 2011/0186249 | A1 * | 8/2011 | Coleman et al. | 160/405 |

* cited by examiner

*Primary Examiner* — Katherine Mitchell
*Assistant Examiner* — Johnnie A Shablack

(57) ABSTRACT

A portal extends through a vertical surface. The portal is bounded laterally by a vertical closing rail and a parallel opening rail. A flexible door has a size essentially equal to that of the portal. The door has an interior edge and an exterior edge. The interior edge is secured within the closing rail. Guide mechanisms include fixed upper and lower tracks. The upper and lower tracks are adapted to receive and guide the movement of the door when moving to and from an open orientations. A closure assembly includes upper and lower cables and pulleys adapted to move the door to the closed orientation.

2 Claims, 3 Drawing Sheets

FIG. 2
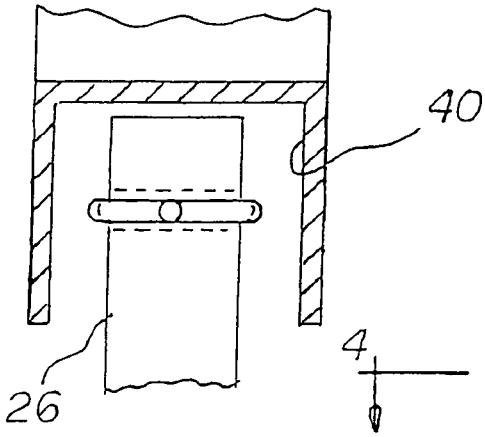
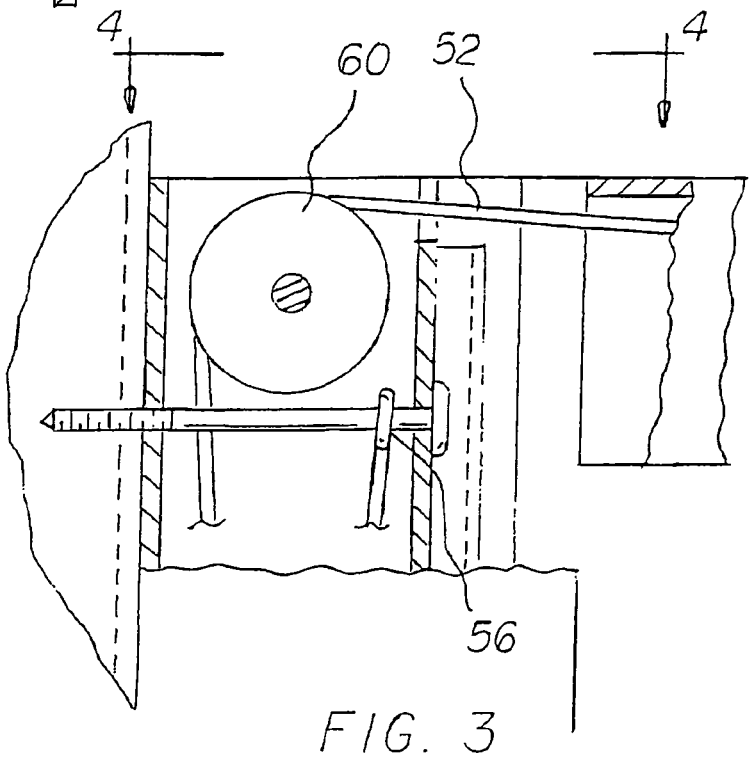
FIG. 3
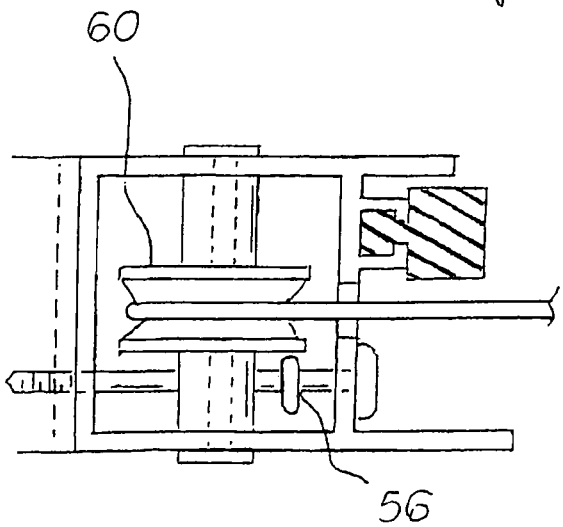
FIG. 4

FIG. 5
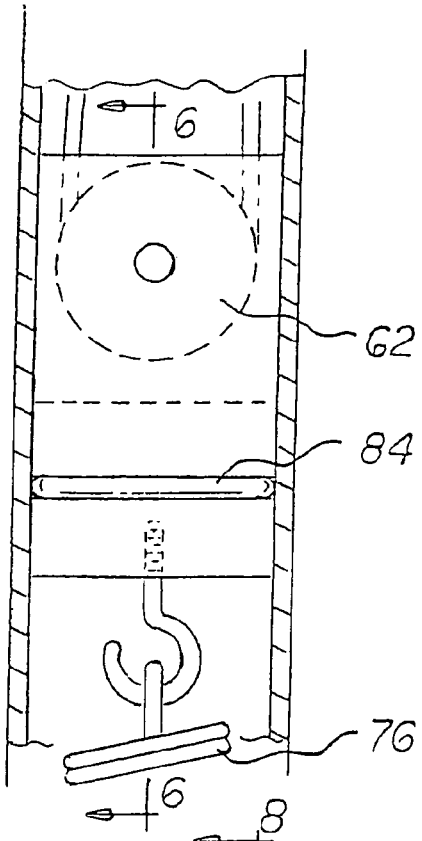
FIG. 6
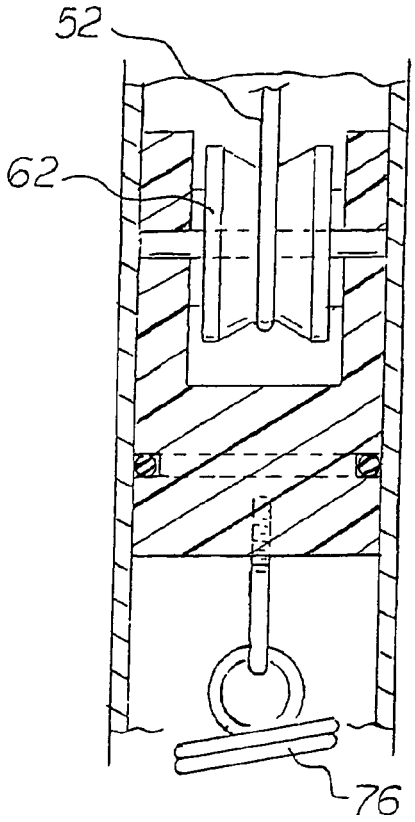
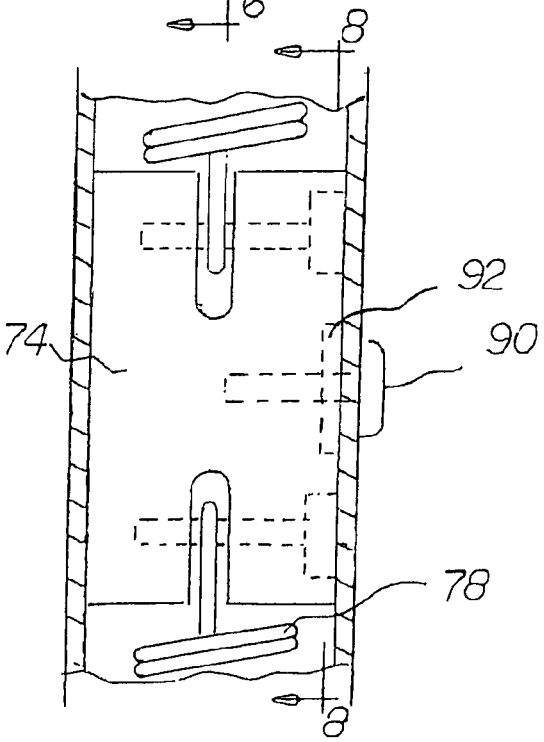
FIG. 7
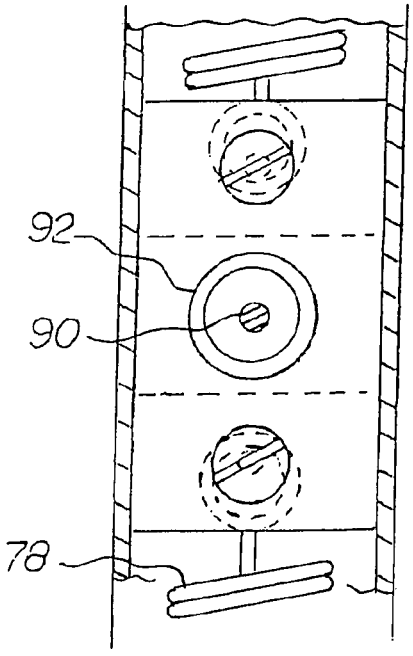
FIG. 8

CLOSING-BIASED RETRACTABLE SCREEN DOOR SYSTEM

BACKGROUND OF THE INVENTION

Field of the Invention

The present invention relates to a closing-biased retractable screen door system and more particularly pertains to rolling up a flexible screen material to move a door to an open orientation, the system adapted to unroll the flexible screen material to move the door to a closed orientation, all while continuously biasing the door to the closed orientation, the rolling up and the unrolling and the biasing being done in a safe, convenient and economical manner.

SUMMARY OF THE INVENTION

In view of the disadvantages inherent in the known types of door systems of known designs and configurations now present in the prior art, the present invention provides an improved closing-biased retractable screen door system. As such, the general purpose of the present invention, which will be described subsequently in greater detail, is to provide a new and improved closing-biased retractable screen door system and method which has all the advantages of the prior art and none of the disadvantages.

To attain this, the present invention essentially comprises a closing-biased retractable screen door system. First provided a vertical surface. The vertical surface has a rectangular portal. The rectangular portal extends through the vertical surface. The portal is bounded elevationally by a horizontal top rail and a parallel bottom rail. The top and bottom rails are separated by a height. The portal is bounded laterally by a vertical closing rail 22 and a parallel opening rail. The closing and opening rails are separated by a width. The rails are fabricated of a rigid, magnetically responsive material.

A door has a height. The height of the door is essentially equal to the height of the portal. The door has a width. The width of the door is essentially equal to the width of the portal. The door has an interior edge. The interior edge is secured within the closing rail. The door has an exterior edge. The exterior edge is positionable adjacent to the closing rail when in the open orientation. The exterior edge is positionable adjacent to the opening rail when in the closed orientation. The door has a free flexible upper edge. The door has a free flexible lower edge. The exterior edge of the door is rigid. The exterior edge of the door couples the upper and lower edges of the door. Flexible screen material is provided. The flexible screen material is provided within the edges of the door.

Provided next are guide mechanisms. The guide mechanisms include fixed upper and lower tracks. The upper track is secured within the upper rail of the portal. The lower track is secured within the lower rail of the portal. The upper and lower tracks are adapted to receive and guide the movement of the door when moving to and from, and when fixed within, the open orientations. The guide mechanisms include a vertical slot. The vertical slot is provided in the closing rail. In this manner passage is provided for the door when moving between the open and closing orientations. The guide mechanisms include a magnet. The magnet is provided on the exterior edge of the door. In this manner the door is held in the closed orientation. The guide mechanisms further include a handle. The handle is provided on the exterior edge of the door. In this manner the door is manually moved from the closed orientation.

Further provided is a closure assembly. In this manner the door is automatically moved to the closed orientation. The closure assembly includes an upper cable. The closure assembly includes a lower cable. The upper cable has a fixed end 56. The fixed end of the upper cable is attached to the opening rail adjacent to the upper rail. The upper cable has a horizontally reciprocable end. The horizontally reciprocable end of the upper cable is coupled to the exterior edge of the door adjacent to the upper rail. The closure assembly includes an upper fixed pulley. The closure assembly includes a vertically reciprocable upper intermediate pulley. The pulleys are adapted to guide the movement of the upper cable. The lower cable has a fixed end. The fixed end of the lower cable is attached to the opening rail adjacent to the lower rail. The lower cable has a horizontally reciprocable end. The horizontally reciprocable end of the lower cable is coupled to the exterior edge of the door adjacent to the lower rail. The closure assembly includes an lower fixed pulley. The closure assembly includes a vertically reciprocable lower intermediate pulley. The pulleys are adapted to guide the movement of the lower cable. The opening rail has a fixed block. The fixed block is provided in the opening rail intermediate the upper and lower rails. An upper coil spring is provided. The upper coil spring couples the fixed block and the upper intermediate pulley. A lower coil spring is provided. The lower coil spring couples the fixed block and the lower intermediate pulley. The closure assembly is adapted to move the door to the closed orientation.

Provided last is an adjustment subassembly. In this manner selective operator feathering of the movement of the door to the closed orientation is facilitated. The adjustment subassembly includes an upper slide block. The upper slide block is coupled to the upper pulley. In this manner vertical movement is allowed within. The upper slide block has an elastomeric O-ring. In this manner an upper vacuum chamber is created between the upper slide block and the fixed block. The adjustment subassembly includes a lower slide block. The lower slide block is coupled to the lower pulley. In this manner vertical movement is allowed within. The lower slide block has an elastomeric O-ring. In this manner a lower vacuum chamber is created between the lower slide block and the fixed block. The adjustment subassembly also includes an adjustment screw. The adjustment screw is threadedly coupled to the closing rail. The adjustment screw is received in the lower chamber. The lower chamber has an elastomeric ring. The elastomeric ring is provided within the lower chamber. The elastomeric ring is supported on the adjustment screw. In this manner the flow of air from the chamber may be varied. Further in this manner the speed of movement of the door when moving to the closed orientation may be varied.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved closing-biased retractable screen door system which has all of the advantages of the prior art door systems of known designs and configurations and none of the disadvantages.

It is another object of the present invention to provide a new and improved closing-biased retractable screen door system which may be easily and efficiently manufactured and marketed.

It is further object of the present invention to provide a new and improved closing-biased retractable screen door system which is of durable and reliable constructions.

An even further object of the present invention is to provide a new and improved closing-biased retractable screen door system which is susceptible of a low cost of manufacture with regard to both materials and labor, and which accordingly is then susceptible of low prices of sale to the consuming public, thereby making such closing-biased retractable screen door system economically available to the buying public.

Even still another object of the present invention is to provide a closing-biased retractable screen door system for rolling up a flexible screen material to move a door to an open orientation, the system adapted to unroll the flexible screen material to move the door to a closed orientation, all while continuously biasing the door to the closed orientation, the rolling up and the unrolling and the biasing being done in a safe, convenient and economical manner.

Lastly, it is an object of the present invention to provide a new and improved closing-biased retractable screen door system. A portal extends through a vertical surface. The portal is bounded laterally by a vertical closing rail and a parallel opening rail. A flexible door has a size essentially equal to that of the portal. The door has an interior edge and an exterior edge. The interior edge is secured within the closing rail. Guide mechanisms include fixed upper and lower tracks. The upper and lower tracks are adapted to receive and guide the movement of the door when moving to and from an open orientations. A closure assembly includes upper and lower cables and pulleys adapted to move the door to the closed orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross section view taken along line 2-2 of FIG. 1.

FIG. 3 is an enlarged showing taken at Circle 3 of FIG. 1.

FIG. 4 is a plan view taken along line 4-4 of FIG. 3.

FIG. 5 is an enlarged showing taken at Circle 5 of FIG. 1.

FIG. 6 is a cross section view taken along line 6-6 of FIG. 5.

FIG. 7 is a cross section view taken along line 7-7 of FIG. 1.

FIG. 8 is a cross section view taken along line 8-8 of FIG. 5.

The same reference numerals refer to the same parts throughout the various Figures.

DESCRIPTION OF THE PREFERRED EMBODIMENT

Figure 1:
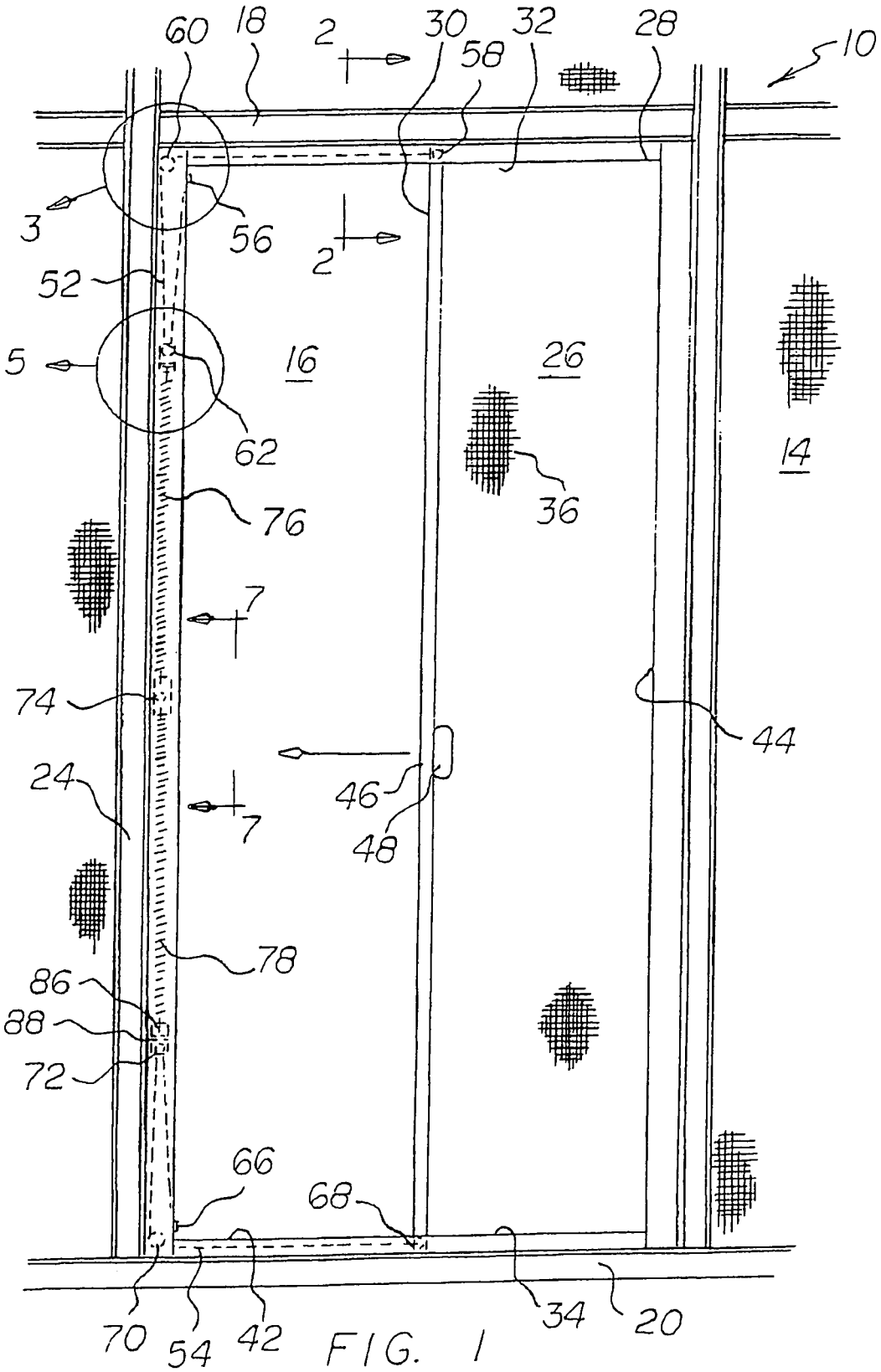
FIG. 1 is a front elevational view of a closing-biased retractable screen door system constructed in accordance with the principles of the present invention.

With reference now to the drawings, and in particular to FIG. 1 thereof, the preferred embodiment of the new and improved closing-biased retractable screen door system embodying the principles and concepts of the present invention and generally designated by the reference numeral 10 will be described.

The present invention, the closing-biased retractable screen door system 10 is comprised of a plurality of components. Such components in their broadest context include a vertical surface, a flexible door, guide mechanisms and a closure assembly. Such components are individually configured and correlated with respect to each other so as to attain the desired objective.

First provided a vertical surface 14. The vertical surface has a rectangular portal 16. The rectangular portal extends through the vertical surface. The portal is bounded elevationally by a horizontal top rail 18 and a parallel bottom rail 20. The top and bottom rails are separated by a height. The portal is bounded laterally by a vertical closing rail 22 and a parallel opening rail. The closing and opening rails are separated by a width. The rails are fabricated of a rigid, magnetically responsive material.

A door 26 has a height. The height of the door is essentially equal to the height of the portal. The door has a width. The width of the door is essentially equal to the width of the portal. The door has an interior edge 28. The interior edge is secured within the closing rail. The door has an exterior edge 30. The exterior edge is positionable adjacent to the closing rail when in the open orientation. The exterior edge is positionable adjacent to the opening rail when in the closed orientation. The door has a free flexible upper edge 32. The door has a free flexible lower edge 34. The exterior edge of the door is rigid. The exterior edge of the door couples the upper and lower edges of the door. Flexible screen material 36 is provided. The flexible screen material is provided within the edges of the door.

Provided next are guide mechanisms. The guide mechanisms include fixed upper and lower tracks 40, 42. The upper track is secured within the upper rail of the portal. The lower track is secured within the lower rail of the portal. The upper and lower tracks are adapted to receive and guide the movement of the door when moving to and from, and when fixed within, the open orientations. The guide mechanisms include a vertical slot 44. The vertical slot is provided in the closing rail. In this manner passage is provided for the door when moving between the open and closing orientations. The guide mechanisms include a magnet 46. The magnet is provided on the exterior edge of the door. In this manner the door is held in the closed orientation. The guide mechanisms further include a handle 48. The handle is provided on the exterior edge of the door. In this manner the door is manually moved from the closed orientation.

Further provided is a closure assembly. In this manner the door is automatically moved to the closed orientation. The closure assembly includes an upper cable 52. The closure assembly includes a lower cable 54. The upper cable has a fixed end 56. The fixed end of the upper cable is attached to the opening rail adjacent to the upper rail. The upper cable has a horizontally reciprocable end 58. The horizontally reciprocable end of the upper cable is coupled to the exterior edge of the door adjacent to the upper rail. The closure assembly includes an upper fixed pulley 60. The closure assembly includes a vertically reciprocable upper intermediate pulley 62. The pulleys are adapted to guide the movement of the upper cable. The lower cable has a fixed end 66. The fixed end of the lower cable is attached to the opening rail adjacent to the lower rail. The lower cable has a horizontally reciprocable end 68. The horizontally reciprocable end of the lower cable is coupled to the exterior edge of the door adjacent to the lower rail. The closure assembly includes an lower fixed pulley 70. The closure assembly includes a vertically reciprocable lower intermediate pulley 72. The pulleys are adapted to guide the movement of the lower cable. The opening rail has a fixed block 74. The fixed block is provided in the opening rail intermediate the upper and lower rails. An upper coil spring 76 is provided. The upper coil spring couples the fixed block and the upper intermediate pulley. A lower coil spring 78 is provided. The lower coil spring couples the fixed block and the lower intermediate pulley. The closure assembly is adapted to move the door to the closed orientation.

Provided last is an adjustment subassembly. In this manner selective operator feathering of the movement of the door to the closed orientation is facilitated. The adjustment subassembly includes an upper slide block 82. The upper slide block is coupled to the upper pulley. In this manner vertical movement is allowed within. The upper slide block has an elastomeric O-ring 84. In this manner an upper vacuum chamber is created between the upper slide block and the fixed block. The adjustment subassembly includes a lower slide block 86. The lower slide block is coupled to the lower pulley. In this manner vertical movement is allowed within. The lower slide block has an elastomeric O-ring 88. In this manner a lower vacuum chamber is created between the lower slide block and the fixed block. The adjustment subassembly also includes an adjustment screw 90. The adjustment screw is threadedly coupled to the closing rail. The adjustment screw is received in the lower chamber. The lower chamber has an elastomeric ring 92. The elastomeric ring is provided within the lower chamber. The elastomeric ring is supported on the adjustment screw. In this manner the flow of air from the chamber may be varied. Further in this manner the speed of movement of the door when moving to the closed orientation may be varied.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A closing-biased retractable screen door system comprising, in combination:

a vertical surface with a portal extending there through, the portal being bounded laterally by a vertical closing rail and a parallel opening rail;

a flexible door having a size essentially equal to that of the portal, the door having an interior edge and an exterior edge, the interior edge secured within the closing rail;

guide mechanisms including a fixed upper track and a fixed lower track, the upper and lower tracks adapted to receive the flexible door and guide movement of the door when the door is moving to and from an open orientation; and a closure assembly including an upper cable and a lower cable with respective upper pulleys and lower pulleys adapted to move the door to a closed orientation;

an adjustment subassembly including a fixed block in the opening rail, the adjustment assembly also including an upper slide block coupled to the upper pulley for vertical movement there with, the upper slide block having an elastomeric O-ring to create an upper vacuum chamber between the upper slide block and the fixed block, the adjustment subassembly including a lower slide block coupled to the lower pulley for vertical movement there with, the lower slide block having an elastomeric O-ring to create a lower vacuum chamber between the lower slide block and the fixed block, the adjustment subassembly also including an adjustment screw threadedly coupled to the closing rail and received in the fixed block, an elastomeric ring within the fixed block and supported on the adjustment screw to vary the flow of air from the upper and lower vacuum chambers so as to vary the speed of movement of the door when moving to the closed orientation.

2. A closing-biased retractable screen door system (10), the system adapted to roll up a flexible screen material to move a door to an open orientation, the system adapted to unroll the flexible screen material to move the door to a closed orientation, all while continuously biasing the door to the closed orientation, the rolling up and the unrolling and the biasing being done in a safe, convenient and economical manner, the system comprising, in combination:

a vertical surface (14) with a rectangular portal (16) extending there through, the portal being bounded elevationally by a horizontal top rail (18) and a parallel bottom rail (20) separated by a height, the portal being bounded laterally by a vertical closing rail (22) and a parallel opening rail separated by a width, the rails being fabricated of a rigid, magnetically responsive material;

a door (26) having a height essentially equal to the height of the portal and a width essentially equal to the width of the portal, the door having an interior edge (28) secured within the closing rail, the door having an exterior edge (30) positionable adjacent to the closing rail when in the open orientation, the exterior edge positionable adjacent to the opening rail when in the closed orientation, the door having a free flexible upper edge (32) and a free flexible lower edge (34), the exterior edge of the door being rigid and coupling the upper and lower edges of the door, and the door further including a flexible screen material (36) within the edges of the door;

guide mechanisms including a fixed upper track (40) and a fixed lower track (42), the upper track secured within the upper rail of the portal, the lower track secured within the lower rail of the portal, the upper track adapted to receive the upper edge of the door, the lower track adapted to receive the lower edge of the door, the upper and lower tracks adapted to guide the movement of the door when moving to and from, and when fixed within, the open and closed orientations, the guide mechanisms including a vertical slot (44) in the closing rail for the passage of the door when moving between the open and closed orientations, the guide mechanisms including a magnet (46) on the exterior edge of the door for holding the door in the closed orientation, the guide mechanisms including a handle (48) on the exterior edge of the door for manually moving the door from the closed orientation;

a closure assembly for automatically moving the door to the closed orientation, the closure assembly including an upper cable (52) and a lower cable (54), the upper cable having a fixed end (56) attached to the opening rail, the fixed end being adjacent to the upper track, the upper cable having an upper horizontally reciprocable end (58) coupled to the exterior edge of the door with the upper horizontally reciprocable end being adjacent to the upper track, the closure assembly including an upper fixed pulley (60) and a vertically reciprocable upper intermediate pulley (62) adapted to guide the movement of the upper cable, the lower cable having a fixed end (66) attached to the opening rail, the fixed end being adjacent to the lower track, the lower cable having a lower horizontally reciprocable end (68) coupled to the exterior edge of the door with the lower horizontally receiprocable end being adjacent to the lower track, the closure assembly including a lower fixed pulley (70) and a vertically reciprocable lower intermediate pulley (72) adapted to guide the movement of the lower cable, the closure assembly including a fixed block (74) in the opening rail intermediate the upper and lower rails, an upper coil spring (76) coupling the fixed block and the upper intermediate pulley, a lower coil spring (78) coupling the fixed block and the lower intermediate pulley, the closure assembly adapted to move the door to the closed orientation; and an adjustment subassembly including an upper slide block (82) coupled to the upper pulley for vertical movement there with, the upper slide block having an elastomeric O-ring (84) to create an upper vacuum chamber between the upper slide block and the fixed block, the adjustment subassembly including a lower slide block (86) coupled to the lower pulley for vertical movement there with, the lower slide block having an elastomeric O-ring (88) to create a lower vacuum chamber between the lower slide block and the fixed block, the adjustment subassembly also including an adjustment screw (90) threadedly coupled to the closing rail and received in the fixed block, an elastomeric ring (92) within the fixed block and supported on the adjustment screw to vary the flow of air from the upper and lower vacuum chambers so as to vary the speed of movement of the door when moving to the closed orientation.

* * * * *